US010485728B2

(12) United States Patent
Suokas et al.

(10) Patent No.: US 10,485,728 B2
(45) Date of Patent: Nov. 26, 2019

(54) FITNESS AND MASSAGE ROLLER

(71) Applicant: PTStudio Oy, Helsinki (FI)

(72) Inventors: Arttu Suokas, Helsinki (FI); Ari Mäkelä, Espoo (FI)

(73) Assignee: PTStudio Oy, Helsinki (FI)

( * ) Notice: Subject to any disclaimer, the term of this patent is extended or adjusted under 35 U.S.C. 154(b) by 635 days.

(21) Appl. No.: 15/217,015

(22) Filed: Jul. 22, 2016

(65) Prior Publication Data

US 2018/0021211 A1 Jan. 25, 2018

(51) Int. Cl.
*A61H 15/00* (2006.01)

(52) U.S. Cl.
CPC ..... *A61H 15/0092* (2013.01); *A61H 15/00* (2013.01); *A61H 2015/0014* (2013.01); *A61H 2201/0103* (2013.01); *A61H 2201/0192* (2013.01); *A61H 2201/1253* (2013.01); *A61H 2201/1284* (2013.01); *A61H 2201/1418* (2013.01); *A61H 2201/1481* (2013.01); *A61H 2201/1695* (2013.01)

(58) Field of Classification Search
CPC ..... A61H 15/00; A61H 15/0078; A61H 15/0085; A61H 15/0092; A61H 2015/0007; A61H 2015/0014; A61H 1/00; A61H 2201/0192; A61H 2201/1695; A61H 2201/1481; A61H 2201/1418; A61H 2201/1253; A61H 2201/0103; A61H 2201/1284; A63B 22/02–0228; A63B 21/068
USPC ..... D24/210–214
See application file for complete search history.

(56) References Cited

U.S. PATENT DOCUMENTS

| | | | | |
|---|---|---|---|---|
| 810,885 | A | 1/1906 | Saighman | |
| 1,577,924 | A * | 3/1926 | Matchett | A61H 23/0254 601/103 |
| 1,882,490 | A | 11/1932 | Falck | |
| 4,081,870 | A | 4/1978 | Iannucci | |
| 4,345,757 | A | 8/1982 | Lo Voi | |
| D330,989 | S | 11/1992 | Evans | |
| 5,637,065 | A | 6/1997 | Chang | |
| 6,398,694 | B1 | 6/2002 | Bountourakis | |
| 7,108,646 | B1 | 9/2006 | Quick | |

(Continued)

FOREIGN PATENT DOCUMENTS

| | | | |
|---|---|---|---|
| CN | 104382734 | A | 3/2015 |
| DE | 202014004901 | U1 | 10/2014 |

(Continued)

OTHER PUBLICATIONS

Finnish Patent and Registration Office, International Search Report issued on PCT/FI2017/050539, dated Oct. 13, 2017.

*Primary Examiner* — Timothy A Stanis
*Assistant Examiner* — Matthew R Moon
(74) *Attorney, Agent, or Firm* — Berggren LLP

(57) ABSTRACT

An adjustable fitness and massage roller formed as a tubular structure is disclosed. The tubular structure has protrusions that can be continuously adjusted via an adjustment mechanism to extend out from the circumferential surface of the roller. In a basic position the circumferential surface is smooth and the he protrusions are not extending outward. In an extreme working position the protrusions are in utmost extended position. The user can adjust the surface of the roller according to her/his preference by adjusting the position of the protrusions.

7 Claims, 7 Drawing Sheets

(56) References Cited

U.S. PATENT DOCUMENTS

Figure 1:
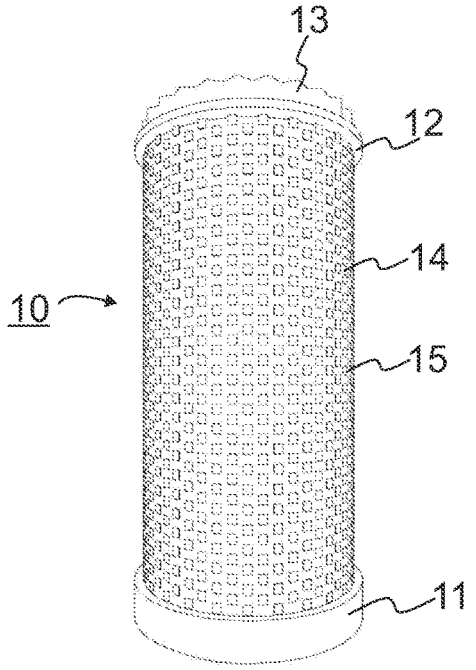

| | | | | |
|---|---|---|---|---|
| 7,137,926 | B2 | 11/2006 | Barrows | |
| D657,830 | S | 4/2012 | Guarrasi | |
| 8,500,663 | B2 | 8/2013 | Godfrey et al. | |
| 8,556,837 | B1 | 10/2013 | Poirier | |
| D693,934 | S | 11/2013 | Lin | |
| 8,821,352 | B2 | 9/2014 | Crowell et al. | |
| D714,952 | S | 10/2014 | Gonglach et al. | |
| 9,132,055 | B1 | 9/2015 | Wallace | |
| 9,168,411 | B2 | 10/2015 | Holman | |
| 9,174,082 | B1 | 11/2015 | Marlow | |
| 9,839,574 | B2 * | 12/2017 | Lawrie | A61H 15/0092 |
| 2002/0193714 | A1 | 12/2002 | Pecora | |
| 2004/0024336 | A1 | 2/2004 | Lin | |
| 2008/0039747 | A1 | 2/2008 | Baerwalde et al. | |
| 2008/0096740 | A1 | 4/2008 | Nichols | |
| 2009/0222994 | A1 | 9/2009 | Wood | |
| 2011/0009248 | A1 | 1/2011 | Bronston et al. | |
| 2011/0152035 | A1 | 6/2011 | Wahl | |
| 2011/0183825 | A1 | 7/2011 | Yang et al. | |
| 2011/0300995 | A1 | 12/2011 | Castiglione | |
| 2012/0035029 | A1 | 2/2012 | Dye | |
| 2012/0065557 | A1 | 3/2012 | Phillips | |
| 2013/0130872 | A1 | 5/2013 | Benne et al. | |
| 2014/0005580 | A1 * | 1/2014 | Brueggemann | A61H 15/0078 601/118 |
| 2014/0128786 | A1 | 5/2014 | Ross | |
| 2015/0018176 | A1 | 1/2015 | Cohen et al. | |
| 2015/0209220 | A1 | 7/2015 | Lin | |
| 2015/0265871 | A1 | 9/2015 | Patel | |
| 2015/0297442 | A1 * | 10/2015 | Bauer | A61H 23/02 601/112 |
| 2015/0343256 | A1 | 12/2015 | Coompol | |
| 2016/0302994 | A1 | 10/2016 | Chen | |
| 2016/0310350 | A1 | 10/2016 | Chen | |

FOREIGN PATENT DOCUMENTS

| | | | |
|---|---|---|---|
| DE | 202015100019 | U1 | 3/2015 |
| EP | 650716 | B1 | 12/1998 |
| EP | 2564828 | A1 | 3/2013 |
| EP | 2862602 | A1 | 4/2015 |
| GB | 289487 | A | 7/1929 |
| GB | 2303793 | A | 3/1997 |
| JP | 2111368 | A | 4/1990 |
| JP | 2001008996 | A | 1/2001 |
| JP | 2001353197 | A | 12/2001 |
| JP | 3551669 | B2 | 8/2004 |
| JP | 2012070789 | A | 4/2012 |
| KR | 20000012233 | A | 3/2000 |
| KR | 431404 | Y1 | 11/2006 |
| KR | 2010124481 | A | 11/2010 |
| SU | 1505547 | A1 | 9/1989 |
| TW | M424966 | U | 3/2012 |
| TW | M504623 | U | 7/2015 |
| WO | 2013001314 | A2 | 1/2013 |
| WO | 2013/025767 | A1 | 2/2013 |
| WO | 2014201120 | A1 | 12/2014 |
| WO | 2015041873 | A1 | 3/2015 |

* cited by examiner

Fig. 8
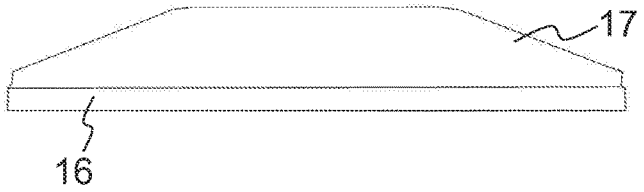
Fig. 9
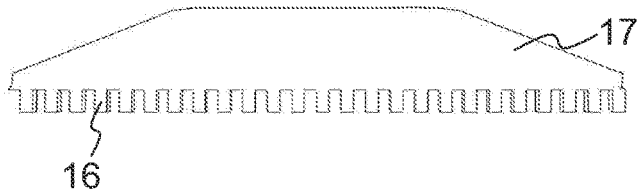
Fig. 10
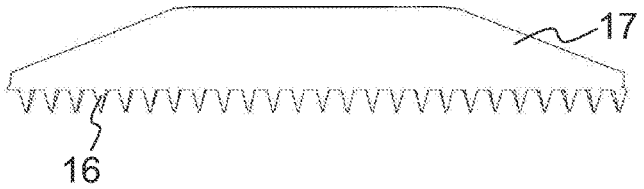
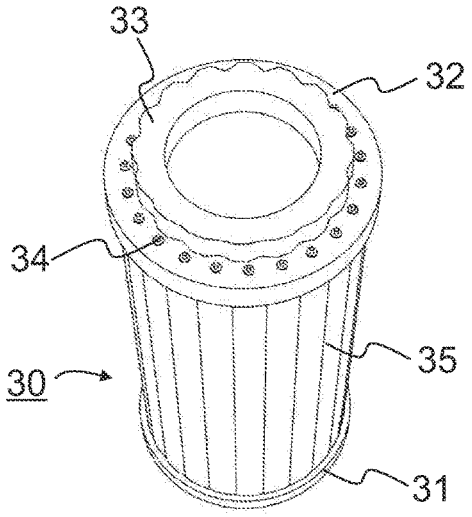
Fig. 11
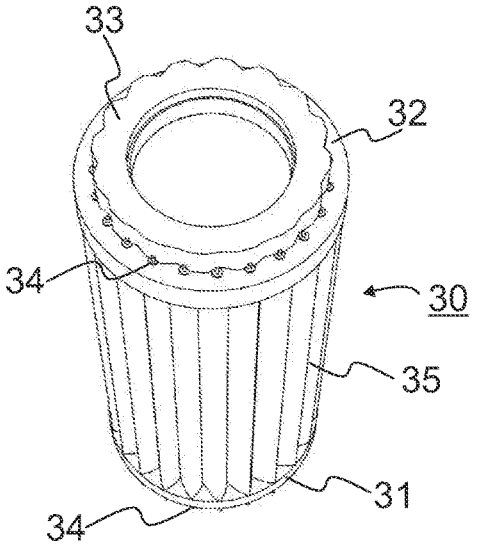
Fig. 12

FITNESS AND MASSAGE ROLLER

FIELD OF THE INVENTION

This invention relates to a fitness and massage roller, especially to a foam roller.

BACKGROUND OF THE INVENTION

Massage has long been used to treat muscles and fasciae, especially tight, stiff muscles, and for prevention of muscle injuries as benefits of massage are well known for example strength, flexibility and endurance, and recovery speed are improved. For example tight muscles are a common condition among athletes and other active persons and it is known to use massage devices, for example fitness and massage rollers, instead of or in addition to traditional massage for relieving the tightness muscles and treatment of fasciae. The fitness and massage rollers are also used in different types of muscles and fasciae treatments of active, passive and other persons having need for the corresponding treatment. These rollers are generally made of plastic, foam, or rubber and the rollers currently on the market can have a smooth or a textured surface. Unfortunately, these devices do not offer any variety in surface density, or size, unless a user buys multiple products, and therefore, the user cannot treat different types of muscle problems with a single device. One type of massage devices is the fitness and massage roller, often called as foam roller, which is often used by placing the roller below the body part needing massage and rolling the body part against the roller and the body weight creating thus the massage force. The foam rollers are used in different types of exercises and are typically solid foam structures with a smooth surface or with a surface with different types of protrusions. The surface structure of different types of foam rollers may be produced of different hardnesses depending on desired results and/or on types of use but variation of surface structure for different needs and/or usages is based on changing the surface structure of the roller or the whole roller and thus various surface parts and/or rollers are needed for different types of purposes. Accordingly, a new and improved fitness and massage roller is needed which can be used for variety of purposes without need of changing rollers or roller parts.

SUMMARY OF THE INVENTION

It is an object of this invention to provide a fitness and massage roller that overcomes disadvantages of prior art devices.

It is an object of this invention to provide a fitness and massage roller, which has adjustment means for adjusting force and power of the influence of the treatment provided by the fitness and massage roller.

It is an object of this invention to provide a fitness and massage roller comprising protrusions, height of which in respect of the surface level of the fitness and massage roller is adjustable and thus the effect providing the treatment can be adjusted.

It is an object of this invention to provide a fitness and massage roller in which the adjustment means provide advantageously continuous height adjustment of the protrusion such that the height of the protrusions can be a selected height between two extreme heights of the protrusions.

It is an object of this invention to provide a fitness and massage roller, wherein position of the protrusions is adjustable to a position between a basic position and a working position by turning the adjustment ring.

Another object of this invention is to provide a fitness and massage roller, wherein the tubular structure of the fitness and massage roller is formed by a surface frame comprising several openings for protrusions.

A further object of this invention is to provide a fitness and massage roller, wherein the tubular structure of the fitness and massage roller is formed by surface parts attached between the end plate and the end flange by attachment means and longitudinal shafts.

Still another object of this invention is to provide a fitness and massage roller, wherein the adjustment means comprise pressure regulating means for regulating pressure inside the protrusions.

Still another object of this invention is to provide a fitness and massage roller, having a tubular structure and comprising a tubular surface frame having a first end, and a second end, and a circumferential surface; an end plate attached to the first end; an end flange attached to the second end; an adjustment means attached to the end flange; a multitude of protrusions having a height extending from the circumferential surface, said height being continuously adjustable between a first and a second extreme position by the adjustment means, wherein the first extreme position is a basic position where the circumferential surface is smooth and the second extreme position is a position where full height of the protrusions extend from the circumferential surface.

Still another object of this invention is to provide a fitness and massage roller, wherein a soft material layer covers the surface frame.

Still another object of this invention is to provide a fitness and massage roller, wherein the first extreme position of the protrusions is when each surface part has only one of its three sides circumferentially exposed and the other extreme position when each surface part has two of its three sides circumferentially exposed.

Still another object of this invention is to provide a fitness and massage roller, wherein the surface parts have three sides and thus a triangular cross section.

Still another object of this invention is to provide a fitness and massage roller, wherein the adjustment ring is turnably connected to the longitudinal tooth ring for turning the ring and thereby moving the surface parts.

Still another object of this invention is to provide a fitness and massage roller, wherein tubular surface frame comprises a longitudinal tooth ring attached in between of the endplate and end flange and the surface parts are attached with longitudinal shafts between the end plate and the end flange in such a way that each surface part locates in between two adjacent teeth of the tooth ring.

Still another object of this invention is to provide a fitness and massage roller, wherein the surface parts form the protrusions.

Still another object of this invention is to provide a fitness and massage roller, wherein the tubular surface frame is formed of a multitude of surface parts attached between the end plate and the end flange.

Still another object of this invention is to provide a fitness and massage roller, wherein the protrusion plate has an edge with multitude of protrusions and the openings on the tubular frame are selected from a triangular opening, a rectangular opening, a circular opening, and a needle loop form.

Still another object of this invention is to provide a fitness and massage roller, wherein the protrusion plate has an edge with one continuous protrusion and the openings on the tubular frame are slits.

Still another object of this invention is to provide a fitness and massage roller, wherein the adjustment ring turnably connected to the middle shaft for moving the conical tooth rings and thereby moving the protrusion plates.

Still another object of this invention is to provide a fitness and massage roller, wherein in middle of the shaft threading direction of threads is reversed.

Still another object of this invention is to provide a fitness and massage roller, wherein the conical tooth rings are attached threadedly with the middle shaft.

Still another object of this invention is to provide a fitness and massage roller, wherein the middle structure comprises conical tooth rings movably attached at both ends of the middle shaft, and the protrusion plates have a truncated triangular form with two longitudinal edges and each longitudinal edge locates between two adjacent teeth of the conical tooth rings.

Still another object of this invention is to provide a fitness and massage roller, wherein the tubular surface frame comprises a middle structure comprising a middle shaft having two ends, and a multitude of protrusion plates comprising an edge with one or more protrusions attached on the middle shaft in a way that the protrusions are toward the circumferential surface.

Still another object of this invention is to provide a fitness and massage roller, wherein the tubular surface frame comprises a multitude of openings on the circumferential surface through which the protrusions extend.

It is an object of this invention to provide fitness and massage roller having a tubular structure and comprising: a tubular surface frame having a first end, and a second end, and a circumferential surface; an end plate attached to the first end; an end flange attached to the second end; a turnable adjustment ring attached to the end flange; a multitude of protrusions having a height extending from the circumferential surface, said height being continuously adjustable between a first and a second extreme position by the turnable adjustment ring, wherein the first extreme position is a basic position where the circumferential surface is smooth and the second extreme position is a position where full height of the protrusions extend from the circumferential surface.

SHORT DESCRIPTION OF THE FIGURES

In FIG. 1 is schematically shown as an overview one example of the fitness and massage roller according to the invention in its basic position.

Figure 2:
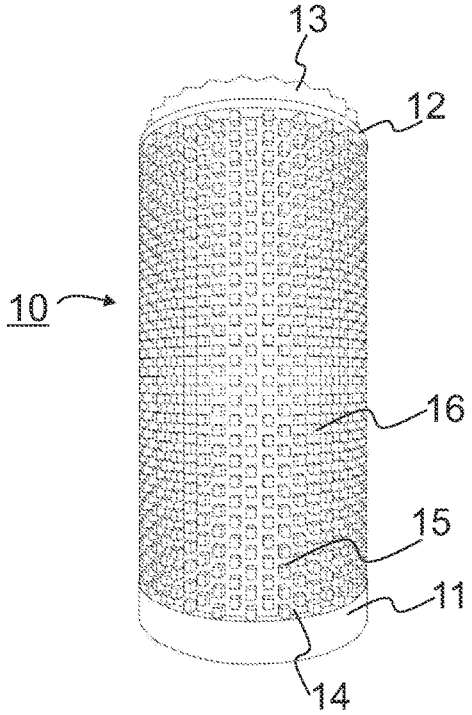

In FIG. 2 is schematically shown as an overview the example according to FIG. 1 in a working position with the protrusions up.

Figure 3:
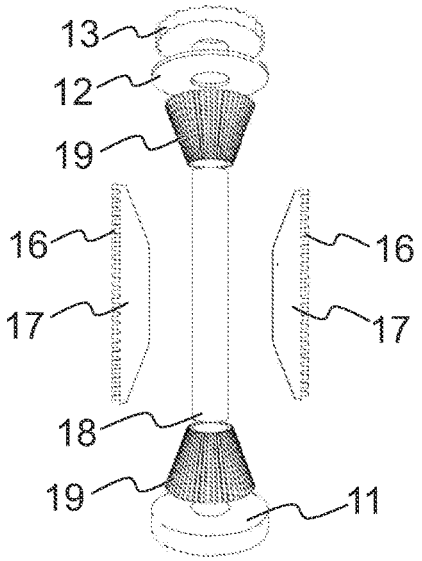

In FIG. 3 is schematically shown the example according to FIGS. 1-2 as an exploded view without the surface frame.

Figure 4:
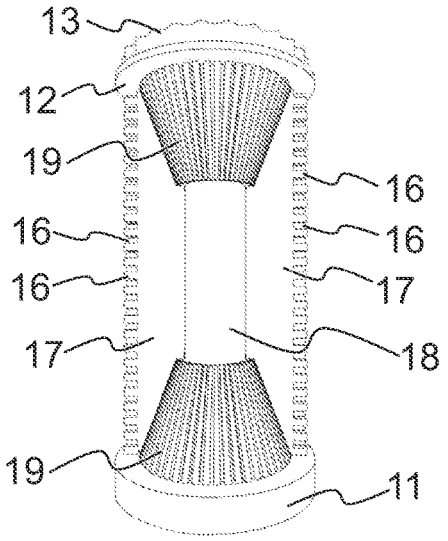

In FIG. 4 is schematically shown the example according to FIGS. 1-3 assembled without the surface frame and with some of the protrusion plates removed and the protrusions down.

Figure 5:
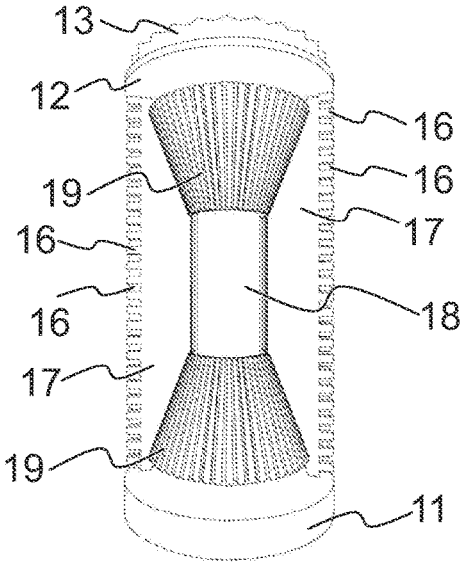

In FIG. 5 is schematically shown the example according to FIGS. 1-4 assembled without the surface frame and with some of the protrusion plates removed and the protrusions up.

Figure 6:
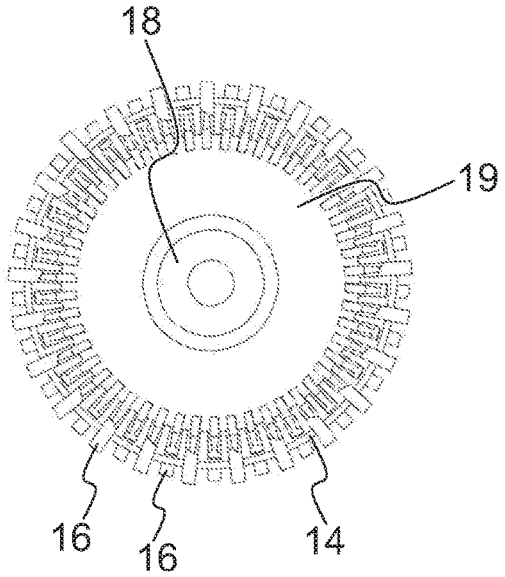

In FIG. 6 is schematically shown an end view the example according to FIGS. 1-5 showing the mechanism for moving the protrusions with the protrusions up (in an extended position).

Figure 7:
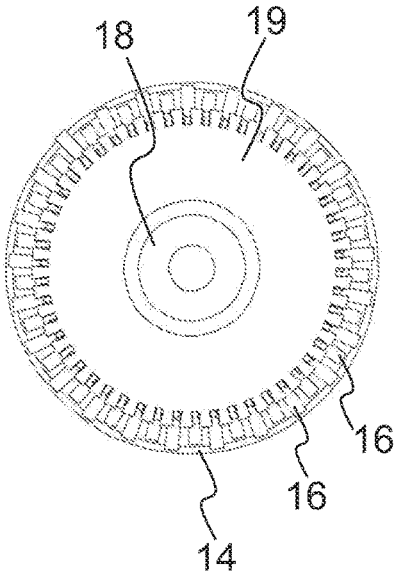

In FIG. 7 is schematically shown an end view the example according to FIGS. 1-6 showing the mechanism for moving the protrusions with the protrusions down.

In FIG. 8 is schematically shown one example of protrusion plate for the example according to the FIGS. 1-7.

In FIG. 9 is schematically shown another example of protrusion plate for the example presented in the FIGS. 1-7.

In FIG. 10 is schematically shown yet another example of protrusion plate for the example according to the FIGS. 1-7.

In FIG. 11 is schematically shown as an overview another example of the fitness and massage roller according to the invention in its basic position.

In FIG. 12 is schematically shown as an overview the example according to FIG. 11 in a working position with the protrusions up (in extended position).

Figure 13:
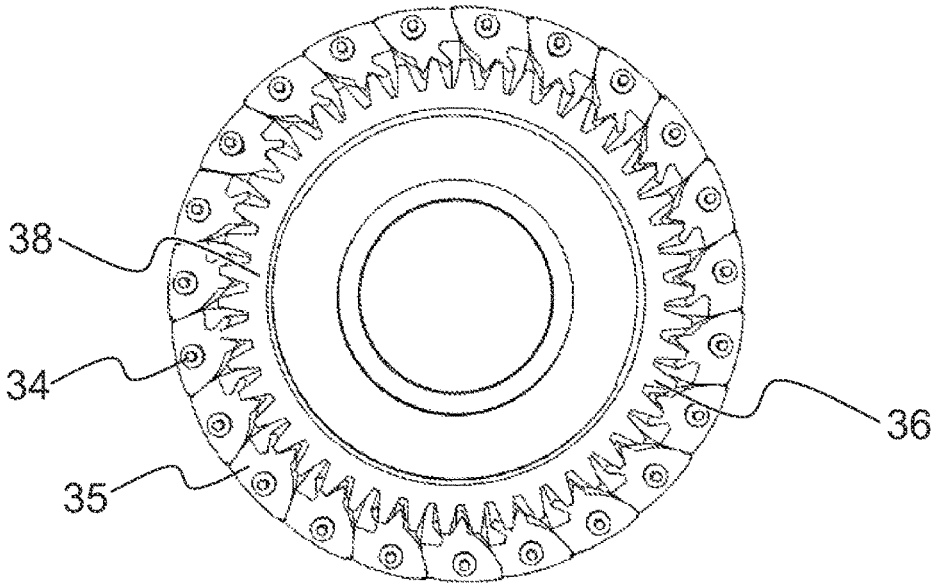

In FIG. 13 is schematically shown an end view the example according to FIGS. 11-12 showing the mechanism for moving the protrusions with the protrusions down.

Figure 14:
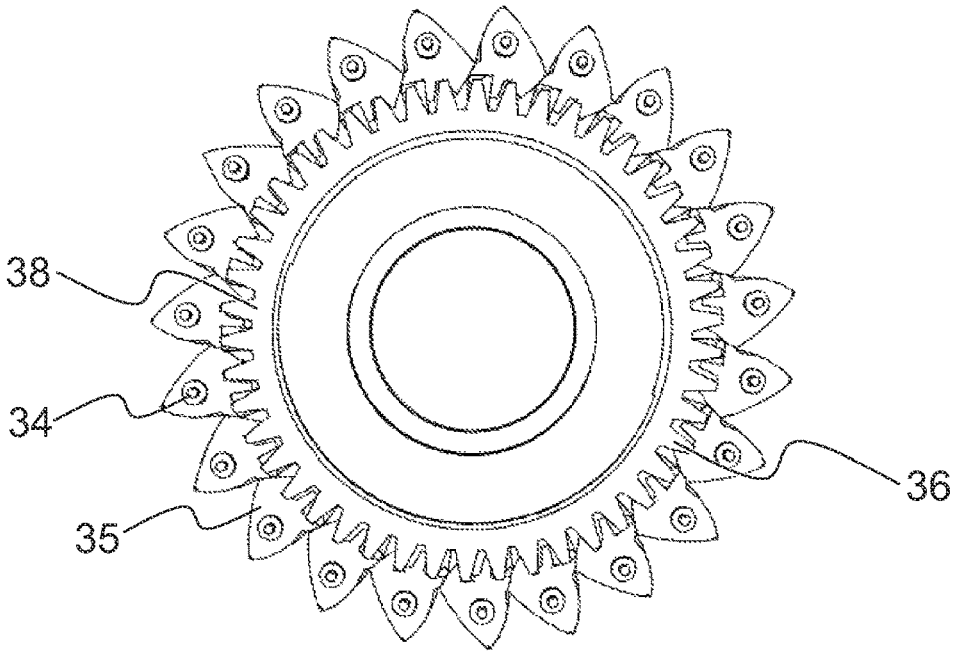

In FIG. 14 is schematically shown an end view the example according to FIGS. 11-13 showing the mechanism for moving the protrusions with the protrusions up (in extended position).

Figure 15:
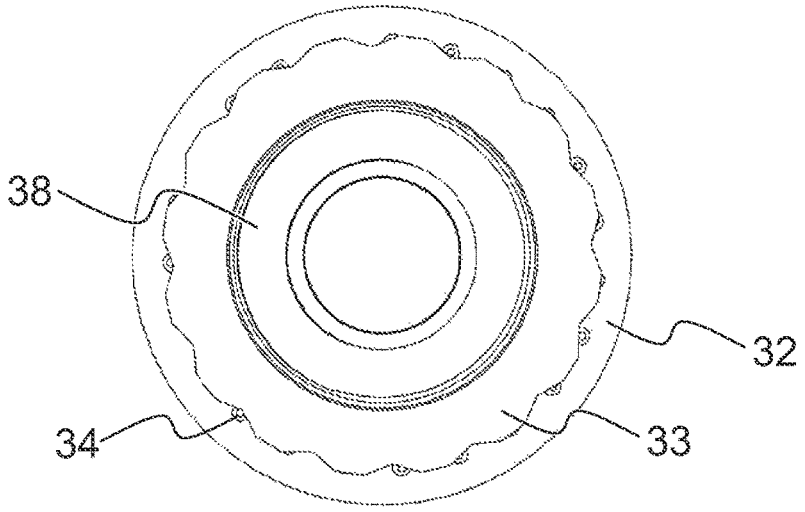

In FIG. 15 is schematically shown an end view of the example according to FIGS. 11-14 showing the adjustment means.

Figure 16:
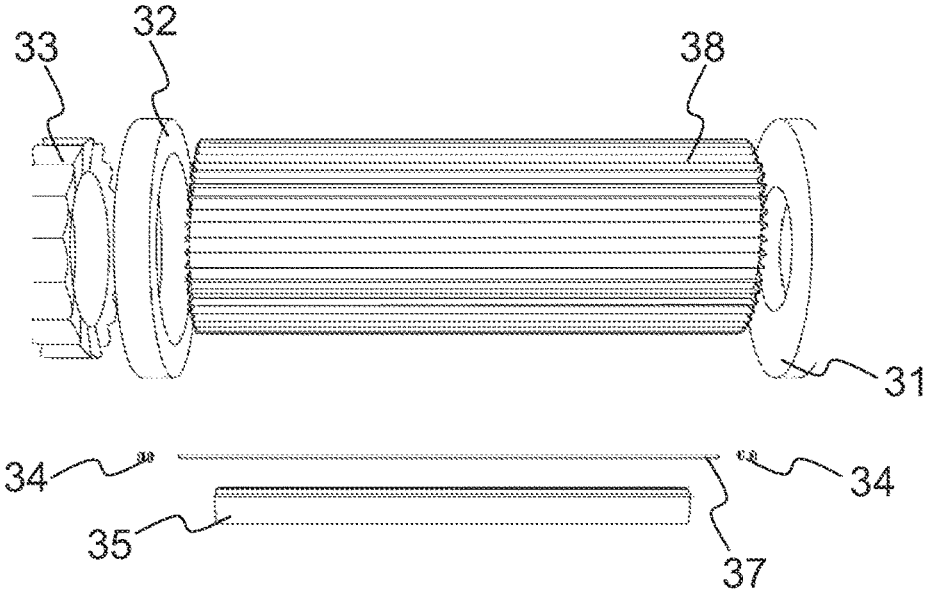

In FIG. 16 is schematically shown the example according to FIGS. 11-15 as an exploded view.

Figure 17:
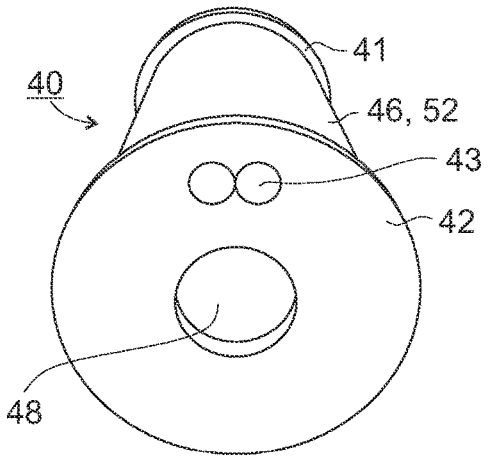

In FIG. 17 is schematically shown as an overview of yet another example of the fitness and massage roller according to the invention in its basic position.

Figure 18:
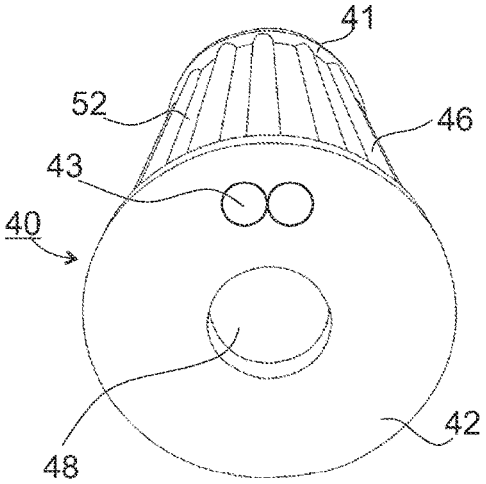

In FIG. 18 is schematically shown as an overview the example according to FIG. 17 in a working position with the protrusions up.

Figure 19:
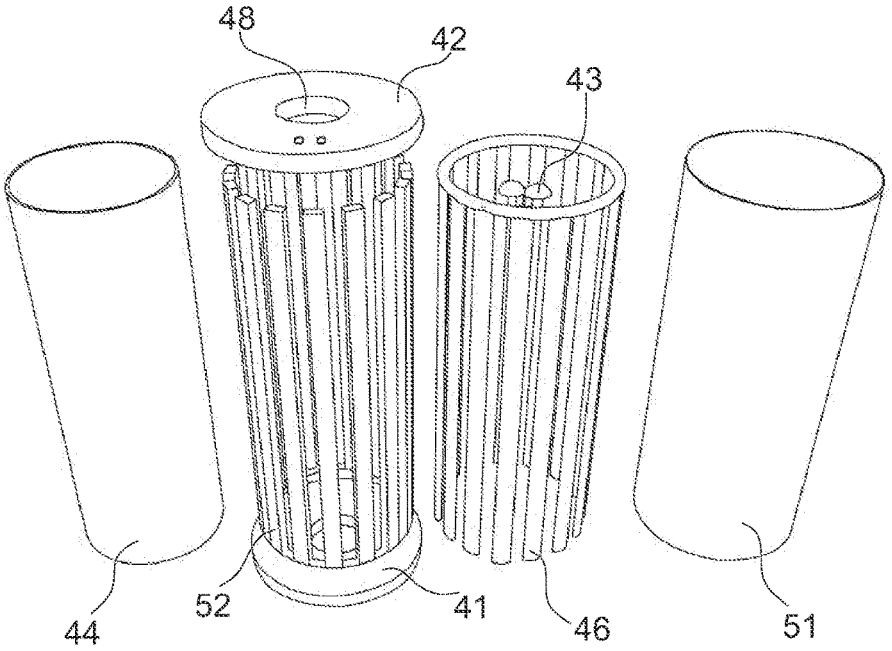

In FIG. 19 is schematically shown the example according to FIGS. 17-18 as an exploded view.

Figure 20:
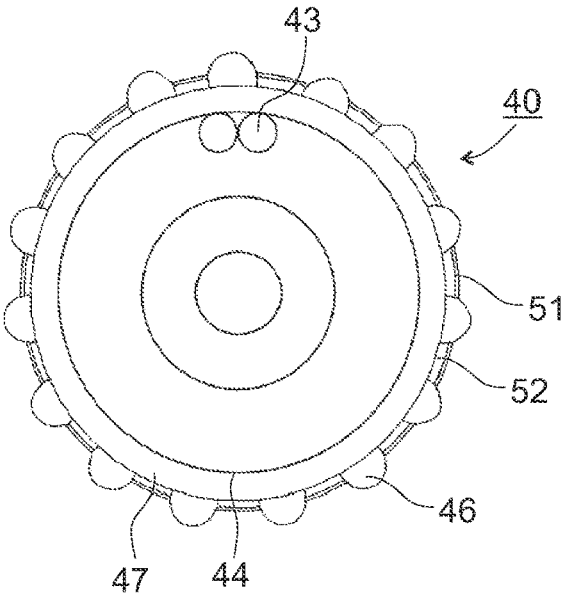

In FIG. 20 is schematically shown the example according to FIGS. 17-19 as an end view without the surface frame and with the protrusions up.

Figure 21:
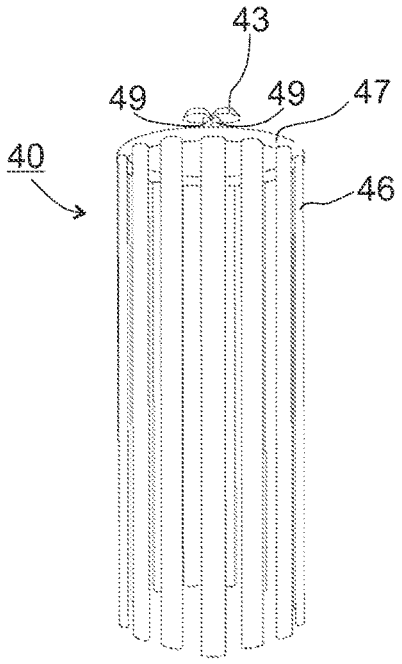

In FIG. 21 is schematically shown the example according to FIGS. 17-20 as a side view without the surface frame and with the protrusions uninflated.

Figure 22:
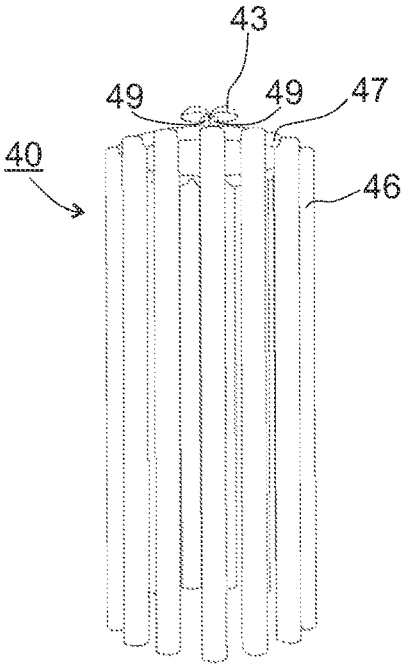

In FIG. 22 is schematically shown the example according to FIGS. 17-21 as a side view without the surface frame and with the protrusions inflated.

DESCRIPTION OF THE INVENTION

The present invention provides a fitness and massage roller that overcomes disadvantages of prior art devices. The invention provides an advantage of providing a fitness and massage roller, which has adjustment means for adjusting force and power of the influence of the treatment provided by the fitness and massage roller. It also provides for possibility of variable usages of the fitness and massage roller for different usages, for example massage of muscles and treatment of fasciae. The fitness and massage roller comprises protrusions, height of which in respect of the surface frame level of the fitness and massage roller is adjustable and thus the effect providing the treatment can be adjusted. Thus safe use of the fitness and massage roller is provided as different muscles parts of the human body should be treated by different force and power. This also provides for the possibilities of variable usages for different purposes for example stretching, massaging, pre-warming the muscles etc. The adjustment means provide advantageously continuous adjustment. The benefit of the fitness and massage roller according to the invention is also the possibility of increasing or decreasing the effect during the treatment and/or exercise when needed.

In a first aspect, the present invention provides a fitness and massage roller, which has adjustment means for adjusting force and power of the influence of the treatment provided by the fitness and massage roller. The fitness and massage roller comprising protrusions, height of which in respect of the surface level of the fitness and massage roller is adjustable and thus the effect providing the treatment can be adjusted. The protrusions are formed to protrusion plates, which are attached onto a middle shaft of the fitness and massage roller. The protrusions are adjustably movable through openings in a surface frame part of the fitness and massage roller by an adjustment mechanism controlled by turning an adjustment ring. The roller is said to be in a basic position when the protrusions are not extending through the opening and the circumferential surface of the roller is smooth. The roller is said to be in a working position when the protrusions are adjusted to extend out from the openings. The user of the roller can select between numerous working positions depending on how much the protrusions are selected to extend.

In a second aspect, the present invention provides a fitness and massage roller, which has adjustment means for adjusting force and power of the influence of the treatment provided by the fitness and massage roller. The fitness and massage roller comprises protrusions formed by turnable surface parts of the fitness and massage roller. The protrusions are formed by turning a longitudinal toothed ring by an adjustment ring. Again the roller is said to be in basic position when the protrusions are not extending from the circumferential surface. The roller is said to be in a working position when the surface plates are adjusted such that the surface no more is smooth but the protrusions extend from the surface.

In a third aspect the present invention provides a fitness and massage roller, which has adjustment means for adjusting force and power of the influence of the treatment provided by the fitness and massage roller. The adjustment means comprise pressure regulating means for regulating pressure inside the multitude of the protrusions, height of which in respect of the surface level of the fitness and massage roller is adjustable by the adjustment means and thus the effect providing the treatment can be adjusted. The roller is said to be in basic position when the circumferential surface is smooth and in a working position when the pressure inside the protrusions is adjusted such that the protrusions extend from the surface.

The device is now described in reference to FIGS. 1-22. In FIGS. 1-7 is shown one advantageous example of the invention and advantageous protrusion plate examples in FIGS. 8-10 and in FIGS. 11-16 another advantageous example of the invention and in FIGS. 17-22 yet another advantageous example of the invention.

In FIG. 1 is schematically shown as an overview one example of the fitness and massage roller formed as a tubular structure and comprising an end plate 11 for the first end and an end flange 12 for the second end. Onto the end flange 12 an adjustment ring 13 is attached. The tubular body of the fitness and massage roller 10 is formed by a surface frame 14 comprising several openings 15 for protrusions 16 (FIG. 2). In FIG. 1 the fitness and massage roller 10 is shown in its first extreme position i.e. basic position, in which the protrusions 16 are down i.e. not protruding through the openings 15 of the surface frame 14 and thus the surface of the surface frame 14 is smooth. The frame structure of the roller 10 comprises the surface frame 14 and the end plate 11 and the end flange 12.

As shown in FIG. 2 schematically the fitness and massage roller 10 has in its second extreme position i.e. in one working position the protrusions 16 up i.e. protruding through the openings 15 of the surface frame 14. The position of the protrusions 16 is adjusted by turning the adjustment ring 13 and thus height of the protrusions 16 in respect to the level of the outer circumference of the surface frame 14 can be adjusted. A working position is any position between the first and the second extreme position and the user can choose the preferred working position.

In FIG. 3 is schematically shown the main parts of the fitness and massage roller as an exploded view without the surface frame 14 (FIGS. 1-2). The fitness and massage roller comprises the end plate 11 for the first end and the end flange 12 for the second end. Onto the end flange 12 the adjustment ring 13 is to be attached. A middle shaft 18 forms the middle structure of the tubular structure of the fitness and massage roller, onto which protrusion plates 17 comprising the protrusions 16 are to be attached. At each end of the middle shaft 18 a tooth ring 19 of conical shape is to be attached by threaded attachment.

In FIG. 4 is schematically shown the main parts of the fitness and massage roller 10 (FIGS. 1 and 2) assembled without the surface frame 14 (FIGS. 1 and 2) and with some of the protrusion plates 17 removed and the protrusions 16 down and thus the fitness and massage roller in basic position. The protrusion plates 17 are attached to the tooth rings 19, which are by threaded attachment attached to the middle shaft 18 such that the protrusions 16 are towards the outer circumference of the fitness and massage roller. The protrusion plate 17 has truncated triangular form and longitudinal sides of the protrusion plate 17 are respectively attached to the tooth rings 19 at each end of the fitness and massage roller. As can be seen from the figure the fitness and massage roller 10 (FIGS. 1 and 2) comprises several protrusion plates 17 located spaced apart on the middle shaft 18 the truncated end of each protrusion plate 17 on the shaft 18 and the ends with the protrusions 16 extending outwards spaced apart in circumferential direction. The longitudinal sides of the protrusion plate 17 are located between two adjacent teeth of the tooth ring 19 respectively at each end of the fitness and massage roller. The end with smaller diameter of the truncated cone shaped i.e. conical tooth ring 19 is attached to the middle shaft 18 and the end with greater diameter of the truncated cone shaped tooth ring 19 is movably attached at the first end of the fitness and massage roller and at the second end of the fitness and massage roller such that they move towards each other in the axial direction of the middle shaft 18 by means of treaded portions on the middle shaft 18 and away from the ends respectively, when the protrusions 16 are moved upwards. Onto the end flange 12 the adjustment ring 13, which is operatively connected to the protrusion plates 17, is attached at the second end of the fitness and massage roller.

In FIG. 5 is schematically shown the main parts of the fitness and massage roller 10 (FIGS. 1 and 2) assembled without the surface frame 14 (FIGS. 1 and 2) and with some of the protrusion plates 17 removed and the protrusions 16 up and thus the fitness and massage roller in working position. The protrusion plates 17 are attached onto the middle shaft 18 such that the protrusions 16 are towards the outer circumference of the fitness and massage roller. The protrusion plate 17 has truncated triangular form and longitudinal sides of the protrusion plate 17 are respectively attached to the tooth rings 19 at each end of the fitness and massage roller. As can be seen from the figure the fitness and massage roller 10 (FIGS. 1 and 2) comprises several protrusion plates 17 located spaced apart on the middle shaft 18, the truncated end of each protrusion plate 17 on the shaft 18 and the ends with the protrusions 16 extending outwards spaced apart in circumferential direction. The longitudinal sides of the protrusion plate 17 are located between two adjacent teeth of the tooth ring 19 respectively at each end of the fitness and massage roller. The end with smaller diameter of the conical, truncated cone shaped tooth ring 19 is movably attached to the middle shaft 18 and to the end with greater diameter of the truncated cone shaped, conical tooth ring 19 is attached at first end of the fitness and massage roller and at the second end of the fitness and massage such that they move towards each other in the axial direction of the middle shaft 18 by means of the threaded portions on the middle shaft and away from the ends respectively, when the protrusions 16 are moved upwards. Onto the end flange 12 the adjustment ring 13, which is operatively connected to the protrusion plates 17, is attached at the second end of the fitness and massage roller.

In FIG. 6 is schematically shown an end view of the fitness and massage roller from the second end showing the mechanism for moving the protrusions 16. In this figure the fitness and massage roller 10 (FIGS. 1 and 2) is in a working position i.e. the protrusions 16 up and in FIG. 7 is schematically shown an end view the fitness and massage roller from the second end showing the mechanism for moving the protrusions 16. In this figure the fitness and massage roller 10 (FIGS. 1 and 2) is in basic position i.e. the protrusions 16 are down. As can be seen from the FIGS. 6 and 7 the protrusions 16 are located at respective openings 15 (FIG. 2) in the surface frame 14 and thus when the adjustment ring 13 is (FIGS. 1-3) turned the respective tooth ring 19 moves the protrusions 16 correspondingly. The protrusions 16 extend from between two adjacent teeth outwards in direction from the middle shaft 18 radially.

In the example of the fitness and massage roller 10 shown in FIGS. 1-7 the fitness roller 10 has the basic position and a working position in respect of the location of the protrusions 16 in radial direction. The protrusions 16 can be located at any position between two extreme positions (the basic position and the extreme working position) by adjusting the adjustment mechanism by the adjustment ring 13, by which the middle shaft is turned. The middle shaft 18 has a threaded portion at least at each end for attachment of the tooth rings 19. In the middle of the shaft the threading direction of the threads is changed such that the position of the protrusion plates 17 in respect of the movement of the tooth rings 19 closer or further away from each other during the turning of the adjustment ring 13. The tooth rings 19 have inner threading to fit the corresponding threaded portions of the middle shaft 18. The threaded portions on the middle shaft 18 change direction of rotation in axial direction on the middle of the middle shaft 18. The middle shaft 18 is attached to the adjustment ring 13 and at the second end extends through opening of the end flange 12 and at the first end is supported to the opening of the end plate 11. The conical tooth rings 19 have the inner threads that fit to the threaded portions of the middle shaft 18. When the adjustment ring 13 is turned in one direction, the middle shaft 18 turns and thus the conical tooth rings 19 are moved towards each other and correspondingly turning of the adjustment ring 13 is turned to the other direction the conical tooth rings 19 are moved away from each other. When the tooth rings 19 are moved towards each other, they push the protrusion plates 17 and thus the protrusions are moved upwards. When the tooth rings 19 are moved away from each other, the protrusion plates 17 are pulled and thus the protrusions are moved downwards. The conical tooth rings 19 and the protrusion plates 17 are form fittingly connected to each other by which the pulling is provided.

Instead of this arrangement provided by the tooth rings the protrusions 16 can be moved by an adjustment mechanism, in which the adjustment ring 13 is provided with and inclined groove or like, into which a pin or corresponding of the adjustment ring 13 fit and when turning the adjustment ring 13, the pin is movable in the groove thus moving the protrusions and adjusting their position to any position between the basic position and the working position. The end plate 11 and end flange 12 support the structure of the fitness and massage roller 10 and also support and cover the adjustment mechanism. The surface frame 14 is a tubular frame with openings 15 for the corresponding protrusions 16. The openings 15 can have various shapes for example from a slot like shape extending in longitudinal direction of the fitness and massage roller 10, a rectangular or circular opening shape to a very small needle hoop type shape. In the surface frame can be similar or different openings or combinations of different types of openings. On top of the surface frame 14 a soft material layer, for example of elastomer, which adjusts to the outer form created by the protrusions and its changes, can be laid as a top layer material (not shown). The material of the soft material layer can be for example rubber, Akton®, memoryfoam.

In FIG. 8 is schematically shown one example of a protrusion plate 17, in which the protrusion 16 is formed as a longitudinally in longitudinal direction of the protrusion plate 17 extending protrusion 16 with continuous outer edge, which in use will be against the body part to be treated or massaged.

In FIG. 9 is schematically shown another example of a protrusion plate 17, in which the protrusions 16 are formed longitudinally in longitudinal direction of the protrusion plate 17 extending spaced apart protrusions 16 with rectangular outer ends, which in use will be against the body part to be treated or massaged.

In FIG. 10 is schematically shown yet another example of a protrusion plate 17, in which the protrusions 16 are formed longitudinally in longitudinal direction of the protrusion plate 17 extending spaced apart protrusions 16 with pointed outer ends, which in use will be against the body part to be treated or massaged.

It should be noted that the protrusions 16 can be shaped in various ways, for example with rounded, triangular ends etc.

In FIG. 11 is schematically shown as an overview another example of the fitness and massage roller 30 comprising formed as a tubular structure comprising an end plate 31 for the first end and an end flange 32 for the second end. Onto the end flange 32 an adjustment ring 33 is attached. The tubular body of the fitness and massage roller 30 comprises surface parts 35 attached between and to the end plate 31 and the end flange by attachment means 34 and longitudinal shafts 37 (FIG. 16). In FIG. 11 the fitness and massage roller 30 is shown in it basic position, in which the surface parts 35 forming protrusions in working position (FIG. 12), are down i.e. not protruding and thus the surface of the fitness and massage roller 30 is smooth.

In FIG. 12 is schematically shown as an overview the fitness and massage roller 30 in working position with the surface parts 35 up. The position of the surface parts 35 is adjusted by turning the adjustment ring 33 and thus height of the surface parts 35 in respect to the level of the outer circumference of the fitness and massage roller 30 can be adjusted.

In FIG. 13 is schematically shown an end view of the fitness and massage roller 30. The adjustment mechanism for moving the surface parts 35 comprises toothed ring 38 with teeth 36. Between of two adjacent teeth 36 an end part of corresponding surface part 35 is located such that by turning the adjustment ring 33 the toothed ring 38 and its teeth 36 turn the substantially triangular surface part 35 such that it forms an upward protrusion (FIG. 14) or smooth surface (FIG. 13) with the other surface parts 35. The surface parts have three sides and thus a triangular cross section. The first extreme position of the protrusions is when each surface part has only one of its three sides circumferentially exposed and the other extreme position when each surface part has two of its three sides circumferentially exposed.

In FIG. 14 is schematically shown an end view of the fitness and massage roller 30 showing the adjustment mechanism for turning the surface parts 35 up such that protrusions are formed.

In FIG. 15 is schematically shown an end view of the fitness and massage roller 30 showing the adjustment means comprising the adjustment ring 33 and the toothed ring 38.

In FIG. 16 is schematically shown the fitness and massage roller 30 as an exploded view. The fitness and massage roller 30 comprises the end plate 31, the end flange 32 and the adjustment ring 33 attached onto the end flange 32 turnably. Between of the end plate 31 and the end flange 32 a longitudinal toothed ring 38 is located. The surface parts 35 forming the protrusions of the fitness and massage roller 30 in working position are attached by the longitudinal shafts 37 and attachment means 34 between the end plate 31 and the end flange 32 circumferentially spaced apart.

In the example of the fitness and massage roller 40 shown in FIGS. 11-16 the fitness roller 30 has the basic position and a working position in respect of the location of the protrusions formed by the surface parts 35 in radial direction. The surface parts 35 can be located at any position between two extreme positions (the basic position and the extreme working position) by adjusting the adjustment mechanism by the adjustment ring 33, by which the toothed ring 38 is turned. The longitudinal shafts 37 are located supporting the surface parts 35 such that by turning by the adjustment ring 33 the toothed ring 38 turns and either rise or lower the protrusions formed by the surface parts 35. The end plate 31 and end flange 32 support the structure of the fitness and massage roller 30 and also support and cover the adjustment mechanism. The protrusions can have various shapes formed by one corner of the triangular cross-shape of the surface parts 35. On top of the surface frame 14 a soft material layer, for example of elastomer, which adjusts to the outer form created by the protrusions and its changes, can be laid as a top layer material (not shown). The material of the soft material layer can be for example rubber, Akton®, memoryfoam.

In FIG. 17 is schematically shown as an overview another example of the fitness and massage roller 40 comprising formed as a tubular structure comprising an end plate 41 for the first end and an end flange 42 for the second end. Onto the end flange 42 an adjustment means 43 is attached. The tubular body of the fitness and massage roller 40 comprises and spaced apart in circumferential direction located support parts 52 extending longitudinally between the end flange 42 and the end plate 41. In between the support parts 52 openings for protrusions 46 are formed. Inside the roller is located an inner frame 44 (FIG. 19) of the fitness and massage roller 40 attached between and to the end plate 41 and the end flange 42 by attachment means (not shown). On outer circumferential surface of the inner frame part 44 are located protrusions 46, which are made of hose-like inflatable, advantageously of rubber made, members. The protrusions 46 will be located substantially at the location between the spaced apart support parts 52. The protrusions 46 are connected to a pressure hose 47 connected to the adjustment means 43. The protrusions 46 are formed by adjusting the pressure of the protrusions 46 by leading gaseous substance, advantageously air, via the pressure hose 47, into the protrusions 46. In FIG. 17 the fitness and massage roller 40 is shown in it basic position, in which the protrusions 46 are down i.e. not protruding and substantially at same level as the support parts 52 and thus the surface of the fitness and massage roller 40 is substantially smooth. Onto the end flange 42 attached adjustment means 43 in this example is pressure regulating means by which pressure inside the protrusions 46 is adjusted.

In FIG. 18 is schematically shown as an overview the fitness and massage roller 40 in working position with the protrusions 46 up. The position of the protrusions 46 is adjusted by regulating pressure inside them inside by the pressure regulating means 43 functioning thus as adjustment means 43 for the height of the protrusions 46. Thus the height of the protrusions 46 in respect to the level of the outer circumference of the fitness and massage roller 40 can be adjusted.

In FIG. 19 is schematically shown the fitness and massage roller 40 as an exploded view. The fitness and massage roller 40 comprises the end plate 41, the end flange 42 and the adjustment means 43 attached onto the end flange 42 and to the pressure hose 47 and thus in controlling connection to the protrusions 46. Between of the end plate 41 and the end flange 42 the cylindrical inner part 44 will be located. The protrusions 46 are in connection with the pressure hose 47 and extend between the end plate 41 and the end flange 42 circumferentially spaced apart and located between the support parts 52. The roller 40 may also comprise a soft material layer 51, for example of elastomer, as the outermost surface of the roller 40, which adjusts to the outer form created by the protrusions 46 and its changes, The soft material layer 51 can be laid as a top layer material (not shown). The material of the soft material layer 51 can be for example rubber, Akton®, memoryfoam.

In FIG. 20 is schematically shown an end view of the fitness and massage roller 40. The adjustment mechanism 43 for inflating the protrusions 46 comprises the pressure regulating means 43 for regulating pressure inside the protrusions 46 such that height of the protrusions 46 can be adjusted. The pressure regulating means 43 can be for example a manual air pump, a control valve or a corresponding regulating means, through which fluid, advantageously air, is passed into the system.

In FIGS. 21-22 is schematically shown the example according to FIGS. 17-20 as a side view without the surface frame and with the protrusions 46 down in FIG. 21 and in FIG. 22 without the surface frame and with the protrusions 46 up. The pressure regulating means 43 are connected via the pressure hose 47 to pressure lines 49.

In the example of the fitness and massage roller 40 shown in FIGS. 17-22 the fitness roller 40 has two extreme positions (the basic position and the extreme working position) in respect of the height of the protrusions 46 in radial direction. The height of the protrusions 46 can be at any position between the basic position and the working position by adjusting the pressure inside them by the adjustment mechanism 43. When the pressure increases, inflates the protrusions 46 between the support parts outwards and correspondingly when the pressure decreases the protrusions 46 flatten and move inwardly towards the basic position. The protrusions 46 can have various shapes: they can extend straight in I-form as presented in the figure or they can be for example of V- or S-form in longitudinal direction. On top of the roller 40 a soft material layer, for example of elastomer, which adjusts to the outer form created by the protrusions and its changes. The material of the soft material layer can be for example rubber, Akton®, memoryfoam. The pressure regulation technique can also be used in connection with other variations of the foam roller as described herein.

What is claimed is:

1. A fitness and massage roller having a tubular structure and comprising:

a tubular surface frame having a first end, and a second end, and a circumferential surface;

an end plate attached to the first end;

an end flange attached to the second end;

a turnable adjustment ring attached to the end flange;

a multitude of protrusions having a height extending from the circumferential surface, said height being continuously adjustable between a first and a second extreme position by the turnable adjustment ring, wherein the first extreme position is a basic position where the circumferential surface is smooth and the second extreme position is a position where full height of the multitude of protrusions extend from the circumferential surface; and wherein the tubular surface frame is formed of a multitude of surface parts attached between the end plate and the end flange and the surface parts form the protrusions and the tubular surface frame comprises a longitudinal tooth ring attached in between the endplate and the end flange and the surface parts are attached with longitudinal shafts between the end plate and the end flange in such a way that each surface part is located in between two adjacent teeth of the longitudinal tooth ring.

2. The fitness and massage roller according to claim 1, wherein the turnable adjustment ring is turnably connected to the longitudinal tooth ring for turning the ring and thereby moving the surface parts.

3. The fitness and massage roller according to claim 2, wherein the surface parts have three sides and thus a triangular cross section.

4. The fitness and massage roller according to claim 3, wherein the first extreme position of the protrusions is when each surface part has only one of its three sides circumferentially exposed and the second extreme position when each surface part has two of its three sides circumferentially exposed.

5. The fitness and massage roller according to claim 1, wherein a soft material layer covers the surface frame.

6. A fitness and massage roller having a tubular structure and comprising:

a tubular surface frame having a first end, and a second end, and a circumferential surface;

an end plate attached to the first end;

an end flange attached to the second end;

a turnable adjustment ring attached to the end flange;

a multitude of protrusions having a height extending from the circumferential surface, said height being continuously adjustable between a first and a second extreme position by the turnable adjustment ring, wherein the first extreme position is a basic position where the circumferential surface is smooth and the second extreme position is a position where full height of the multitude of protrusions extend from the circumferential surface and wherein the tubular surface frame is formed of a multitude of surface parts having three sides and a triangular cross section, and the multitude of surface parts being attached between the end plate and the end flange, and the multitude of surface parts forming the protrusions such that the first extreme position of the protrusions is when each surface part of the multitude of surface parts has only one of its three sides circumferentially exposed, and the second extreme position when each surface part of the multitude of surface parts has two of its three sides circumferentially exposed.

7. The fitness and massage roller according to claim 6, wherein a soft material layer covers the surface frame.

* * * * *